United States Patent [19]

Lilly et al.

[11] Patent Number: 4,944,827

[45] Date of Patent: Jul. 31, 1990

[54] LABEL PRINTING SYSTEM FOR A COMPUTER OUTPUT LINE PRINTER

[75] Inventors: Norman R. Lilly, Stratford; M. James Marin, S. Norwalk; Michael E. Field, Brookfield, all of Conn.

[73] Assignee: Pitney Bowes Inc., Stamford, Conn.

[21] Appl. No.: 323,238

[22] Filed: Mar. 15, 1989

Related U.S. Application Data

[63] Continuation of Ser. No. 150,474, Jan. 27, 1988, abandoned, which is a continuation of Ser. No. 883,228, Jul. 8, 1986, abandoned.

[51] Int. Cl.[5] ..... B41J 15/00; B41J 15/18

[52] U.S. Cl. ..... 156/384; 156/584; 101/288; 400/605

[58] Field of Search ..... 156/584, 394, 384; 101/288, 324, 327; 400/605, 584

[56] References Cited

U.S. PATENT DOCUMENTS

| | | | |
|---|---|---|---|
| Re. 30,749 | 9/1981 | Hamisch . | |
| 2,642,172 | 6/1953 | Felber | 400/639.1 |
| 3,026,986 | 3/1962 | Cetran | 400/639.1 |
| 3,526,189 | 9/1970 | Allen | 156/348 |
| 3,912,069 | 10/1975 | Faulhaber | 400/639.1 |
| 4,036,132 | 7/1977 | Ellefson | 101/288 |
| 4,066,015 | 1/1978 | Polko | 101/288 |
| 4,120,245 | 10/1970 | Karp et al. | 101/288 |
| 4,262,591 | 4/1981 | Cook | 101/327 |
| 4,264,396 | 4/1981 | Stewart | 101/288 |
| 4,358,333 | 11/1982 | Holland-Letz | 156/541 |
| 4,432,830 | 2/1984 | Jue | 101/288 |
| 4,452,543 | 6/1984 | Adkisson et al. | 400/605 |
| 4,544,437 | 10/1985 | Gibson | 101/288 |
| 4,700,791 | 10/1987 | Iwasaki et al. | 400/61 |
| 4,759,288 | 7/1988 | Persson | 156/584 |
| 4,813,355 | 3/1989 | Stork | 101/288 |

FOREIGN PATENT DOCUMENTS

| | | | |
|---|---|---|---|
| 155989 | 9/1983 | Japan | 400/531 |
| 205770 | 11/1983 | Japan | 101/288 |
| 171675 | 9/1984 | Japan | 400/639.1 |
| 2072101 | 9/1981 | United Kingdom | 101/288 |
| 2072102 | 9/1981 | United Kingdom | 101/288 |
| 2139150 | 11/1984 | United Kingdom | 101/288 |

OTHER PUBLICATIONS

Dispensa-matic Labeling Dispensers, 4/15/85.

*Primary Examiner*—Clifford D. Crowder

*Attorney, Agent, or Firm*—Robert H. Whisker; Melvin J. Scolnick; David E. Pitchenik

[57] ABSTRACT

A label printing system. The system includes a computer output printer of the type having a platen roller, a bail rod assembly and a tractor feeder, together defining a web path. A separator rod is attached parallel to the bail rod and introduces a separation angle into the web path. Labels attached to a web of released material are peeled by the separation angle after printing. Variable information is printed on a label being processed and the web is advanced to print fixed information on the next label; moving the printed label over the separator rod and peeling it from the web. A thin edge is left attached to facilitate retrieval by the operator of the printed label. A shipping manifest system including the subject label printer is also disclosed.

10 Claims, 3 Drawing Sheets

LABEL PRINTING SYSTEM FOR A COMPUTER OUTPUT LINE PRINTER

This application is a continuation of application Ser. No. 150,474, filed 1/17/88, which is a continuation of application Ser. No. 883,228, filed Jul. 8, 1986, now abandoned.

BACKGROUND OF THE INVENTION

1. Field of the Invention

The subject invention relates to label printers. More particularly it relates to label printers for printing labels containing information which varies from label to label in real time (i.e. for immediate use as the varying information is determined).

It is well known to provide labels which are fixed to a continuous web of release liner. Such labels are fixed to the release liner in a regular pattern by an adhesive which does not cure when in contact with the release liner but remains tacky so that the labels may be removed from the liner and affixed to another object. A typical use for such labels would be as address labels. A web of blank labels could be printed with addresses from a mailing list on the line printer of a computer system then removed from the release liner and affixed to envelopes.

Known information may be pre-printed on such labels using conventional printing technology (e.g. "FRAGILE" or "URGENT" stickers). As noted above information which varies from label to label may be printed as computer output. However, neither of these approaches has proven completely satisfactory for applications which require that labels be printed in real time. For example, in manifest systems used by parcel shippers to determine the shipping costs and generate manifests for items to be shipped it is frequently desirable to provide address labels which include both fixed information, such as the identity of the shipper and variable information which can only be determined at the time the label is printed. Thus, in manifest systems the shippping cost cannot be determined until the parcel is weighed by the manifest system and the label must be printed in real time.

A system for real time label printing is disclosed in reissue patent Re 30,749; for "Label Printing and Applying Apparatus"; to Paul H. Hamisch, Jr.; reissued Sept. 29, 1981. This patent discloses a system for generating unit price labels for use in supermarkets and the like. Also, a computer driven label printer is marketed by the Swedot Corporation of Sweden as its model number 8222.

Though the above described systems do provide real time label printing and separation of printed labels from the release liner they have limited printing capability. Thus when the Sweda system is used in a manifest system it is necessary to pre-print the fixed information on the labels since the Sweda printer is not capable of printing all the necessary information on the labels.

Heretofore computer output line printers have not been used to print labels in real time, though they are capable of printing the full range of necessary information on such labels, because they have lacked the capability to separate labels from the release liner. Without this capability it is necessary for the operator to remove the label by hand; a process which greatly reduces productivity. In the past where labels have been printed by computer it has been found most efficient to provide a separate system for separating the labels from the release liner. Such systems are marketed by the Dispensa-matic division of Commercial Mailing Accessories, Inc. of St. Louis, Mo. In the Dispensa-matic systems, as in most, if not all systems with label separating capability, the labels are separated from the release liner by drawing the web cross a separating edge which introduces an angle into the web path. Because the labels are relatively stiff in comparison to the release liner and the adhesive fixing the labels to the release liner is not cured the angle in the web path causes the labels to peel or separate from the release liner. While analytical determination of the necessary angle is a complex process, involving the stiffness of the labels, the adhesive force between the label and the release liner, the radius of the separating edge, and the force applied to the draw the web over the separating edge, in practice those familier with the label separating art have been readily able to determine appropriate angles through a simple process of trial and error.

Accordingly it is an object of the subject invention to provide a system for printing and dispensing shipping labels, and the like, in real time.

It is a further object of the subject invention to provide a system for printing mailing labels, and the like, containing both fixed and variable information in an efficient manner.

It is a still further object of the subject invention to provide a system for printing mailing labels, and the like, wherein the above objects may be achieved at a low incremental cost.

SUMMARY OF THE INVENTION

The above objects are achieved and the disadvantages of the prior art are overcome in accordance with the subject invention by means of a label printing system which includes a data processing system for generating information to be printed on a label, a printer connected to and responding to the data processing means to print the generated information on the labels; the labels being mounted on a web of label release liner. The printer further includes apparatus for separating the labels from the liner as the web advances. The information printed on the label includes fixed information and variable information which varies from label to label. (By "fixed information" herein is meant information which is either constant from label to label or may be determined for a particular label before the need to dispense the label, i.e. an address, so that such information need not be printed on a label in real time.) The data processing system of the subject invention controls the printer to print the variable information on a label currently being processed and then to advance the web and print the fixed information on the label next following the one being processed; the currently processed label thereby being advanced sufficiently to at least partially separate from the label release liner.

A printer suitable for use in the above described system would be substantially similar to a conventional computer output line printer of the type including a platten roller, a bail rod assembly, and a tractor feeder, together defining a web path along which a web of material would move to be printed; the tractor feeder applying a tension to the web to advance it along the path. The printer would further include apparatus attached to the printer to define a separating edge spaced from and parallel to the bail rod assembly. The separating edge introduces an angle into the web path between the platten roller and the tractor feeder; the angle being sufficient to separate labels mounted on the web of release liner as said web is advanced along the web path.

Those skilled in the art will of course recognize that the fixed information for the first label to be processed should be printed during initialization of the system.

Those skilled in the art will also recognize that the system in accordance with the subject invention advantageously achieves the above described objects and is further advantageous in that many systems with a requirement for real time printing of labels have heretofore required both a separate label printer to print labels and a computer output line printer for printing reports and the like. Other objects and advantages of the subject invention will be apparent to those skilled in the art from consideration of the attached drawings and the detailed description set forth below.

DETAILED DESCRIPTION OF THE PREFERRED EMBODIMENTS

Figure 1:
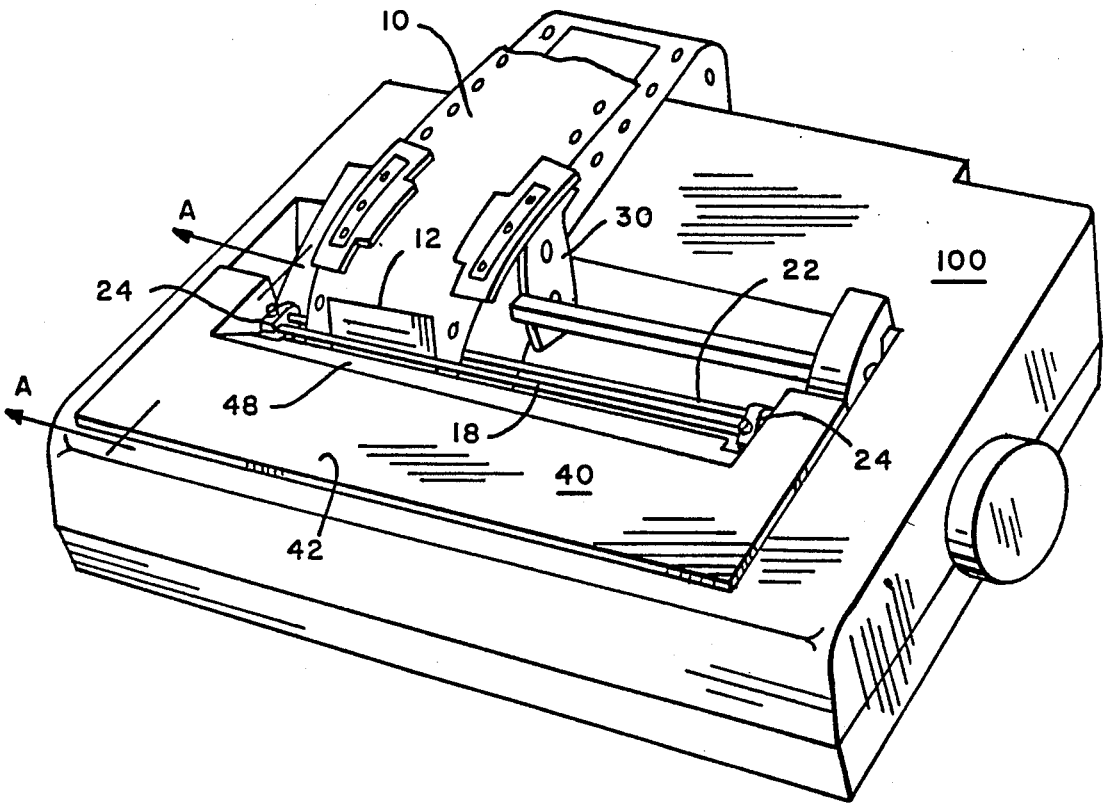
FIG. 1 shows a perspective view of a printer in accordance with the subject invention.

FIG. 1 shows a printer 100 in accordance with the subject invention; including tractor 30, modified cover 40, bail rod 18, separating rod 22, and platten roller 16 (not shown).

Figure 2:
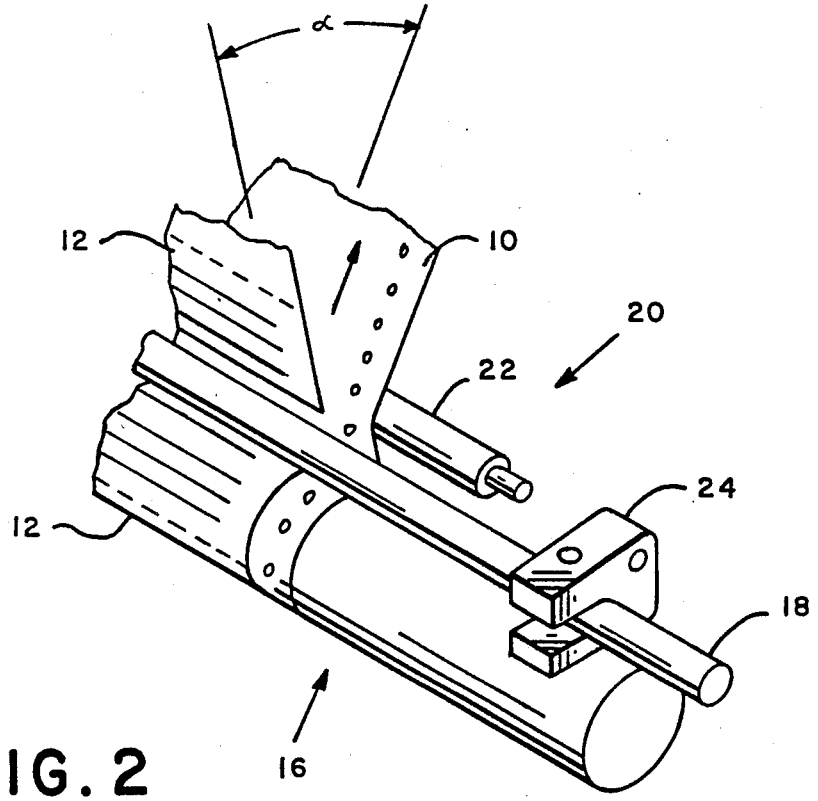
FIG. 2 shows a partially exploded view of a broken-away portion of a printer in accordance with the subject invention.

In FIG. 2 a broken-away portion of printer 100 in accordance with the subject invention is shown. A web 10 of release liner to which labels 12 are affixed in a regular pattern is drawn in a conventional manner by platten roller 16 past a print head (not shown) where fixed and variable information are printed on labels 12. Once past the print head web 10 continues under bail rod 18, back between separating assembly 20 and bail rod 18 and over separating rod 22 to a tractor feeder (not shown).

Separating assembly 20 includes separating rod 22 which is held in a spaced parallel relation to bail rod 18 by first clamp 24 and a second clamp (not shown). Preferably bail rod 22 is free to rotate with the advance of web 10 to reduce the friction force which need be overcome by the tractor feeder.

Figure 3:
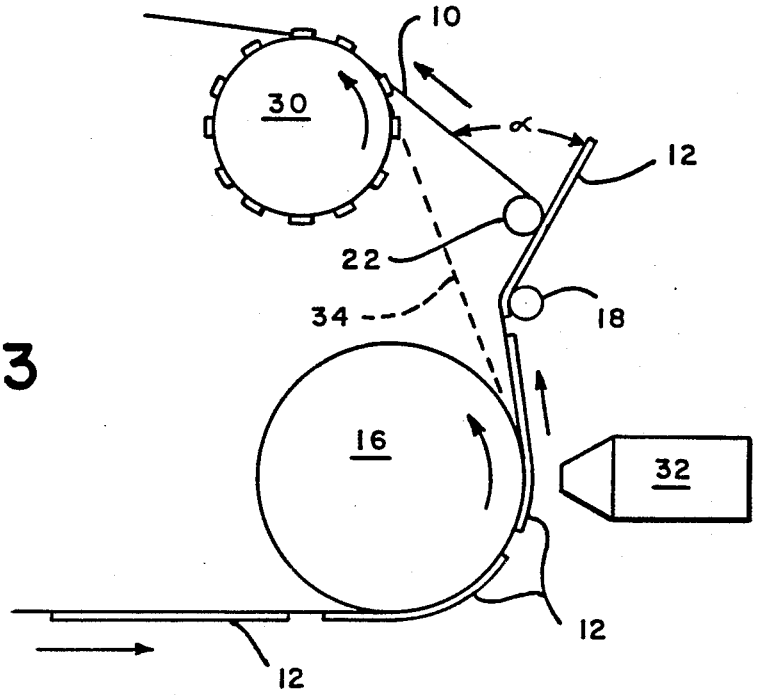
FIG. 3 shows a schematic drawing of the web path through a printer in accordance with the subject invention.

The separating action of the subject invention is shown more clearly in FIG. 3. As described above web 10 is drawn by platten roller 16 past print head 32 where information is printed. Where web 10 is a conventional continuous web of paper stock it passes under bail rod 18 along path 34 to tractor feeder 30, which maintains a tension in web 10, drawing it away from platten roller 16 and feeding it to a conventional output receptacle. In this mode the operation of the subject invention is essentially similar to a conventional computer output line printer. (Note that the separation between bail rod 18 and platten roller 16 is shown exaggerated in FIG. 3 for ease of illustration and preferably bail rod 18 is in contact with web 10 to hold web 10 against platten roller 16.

Where web 10 is a release liner to which 12 are affixed the web path passes under bail rod 18, back between bail rod 18 and separator rod 22, and then to tractor feeder 30. At separator rod 22 an angle, alpha, is introduced between the direction of travel of web 10 and label 12. As described above, angle alpha is chosen with respect to the strength of the adhesive bond between web 10 and label 12 and the stiffness of label 12 so that label 12 is separated from web 10 as web 10 is advanced by tractor 30. From inspection of FIGS. 1 and 2 it will be readily apparent to those skilled int he art that clamps 24, not shown, may easily be adjusted to allow rotation of separator rod 22 around bail rod 18. This rotation allows angle-alpha to be adjusted to achieve effective separation under varying conditions. Preferably the initial or nominal position of separator rod 22 is vertically above bail rod 18.

Those skilled in the art will realize that bail rod 18 is preferably hinged to rotate away from platen roller 16 to facilatate insertion of web 10, and that printers are typically provided with a noise reducing cover which extends to cover both platen roller 16 and tractor feeder 30. In normal operation this presents no problem as a web move along path 34. When a printer is used however in accordance with the subject invention, tension in web 10 is transferred to bail rod 18 and may cause it to pivot away from platen roller 16. Also a cover which extends over platen roller 16 and tractor feeder 30 would clearly interfere with a operator who was trying to remove a printed and separated label 12.

Figure 4:
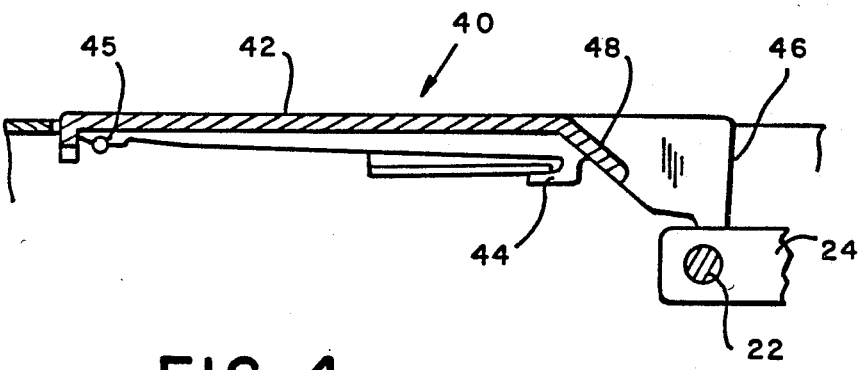
FIG. 4 shows a section view along lines A—A of FIG. 1 of a printer cover in accordance with the subject invention.

While numerous simple expedients will be apparent once the need to prevent rotation of the bail rod is recognized both of the above problems may be solved in accordance with the subject invention means of modified printer cover 40 as shown in FIG. 4.

Cover 40 of FIG. 4 includes a shortened body 42 extending approximately to bail rod 18, allowing an operator access to a separated label 12; clips 44 and notch 45 for attaching cover 40 to printer 100; and structures 46 which bear on bail rod 18 to prevent rotation of bail rod 18 when cover 40 is attached to printer 100. Preferably cover 40 also includes a ramp structure 48 for guiding separated labels 12.

Figure 5:
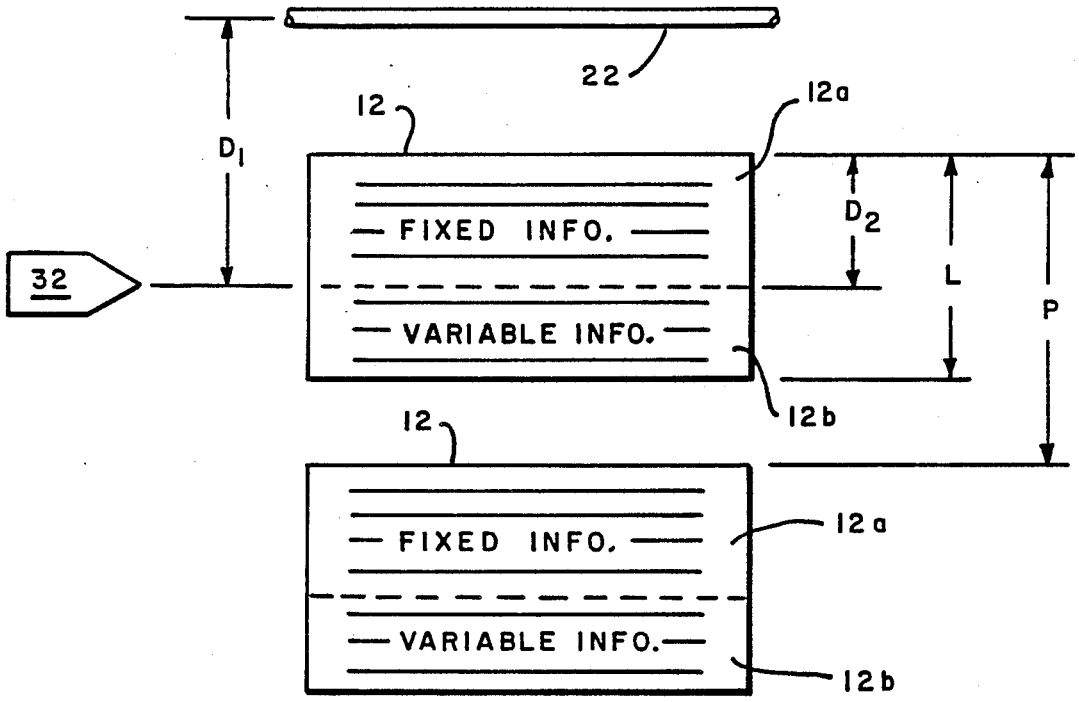
FIG. 5 shows a schematic drawing showing the relationship between the label separation process and the printing process in the system of the subject invention.

In FIG. 5 the relationship between the printing functions and the separation functions of the subject invention is shown. Labels 12 are fixed on a web (not shown). Labels 12 have a length, L, in the direction of motion and are separated by a pitch, P,. Labels 12 include fields **12*a* where fixed information is printed and 12*b* where variable information is printed; field 12*a* having a length, $D_2$, in the direction of motion. Distance $D_l$ between separator rod 22 and print head 32** is measured along the web path.

At the start of each cycle print head 32 is located at the top of field **12*b* for the label currently being processed. Data processing means (not shown) controls print head 32 to first print variable information in field 12*b* of the one of labels 12 currently being processed, advances to the next of labels 12, and then prints fixed information into field 12*a* of the next of labels 12**.

It is thus readily apparent that the separation length, S, is given by:

$$S=P+D_2-D_l.$$

In a preferred embodiment the difference L-S is chosen to be approximately equal to one-sixteeth of an inch. This arrangement leaves printed label 12 attached to the web (not shown) by a small edge so that it may be easily located and removed by an operator.

It will also be apparent to those skilled in the art from consideration of FIG. 5 that were all the information printed on label 12 to be variable, i.e. the entire label printed in one cycle, that, since distance $D_l$ is substantially constrained by the geometry of the printer, a given separation length, S, could only be achieved by increasing the pitch, P; resulting in wastage of material and increased cycle time.

Figure 6:
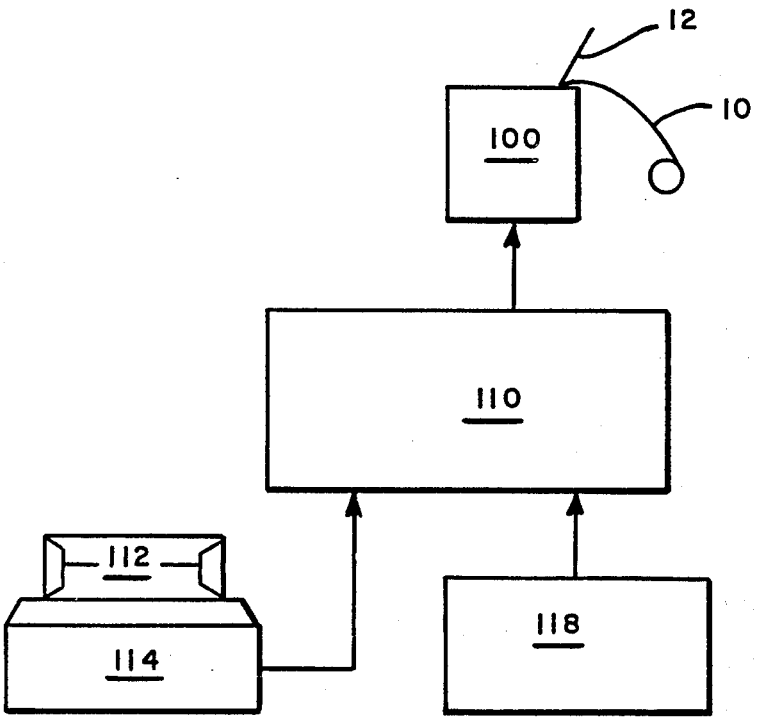
FIG. 6 shows an exploded view of a printer and printer cover in accordance with the subject invention.

FIG. 6 shows a parcel manifest system in accordance with the subject invention. Printer 100 having label printing and separating capabilities as described above is connected to and responds to data processing system 110 to print parcel shipping labels. System 110 receives weight information defining the weight of parcel 112 from scale platform 114 and other information pertaining to parcel 112 through input device 118. (Note input device 118 may be a conventional keyboard or wand reader for entering other information, such as class of service, which pertains to the shipping costs for parcel 112.) After receving the weight information and other information data processing system 110 computes the shipping cost and other variable information, such as an invoice number for package 112, determines the variable information to be printed on label 12 from predetermined rate charts and other information stored in system 110, prints such variable information, and then prints predetermined fixed information on the next of labels 12 to be processed. An operator may then easily remove label 12, which remains fixed to label 10 only by a thin edge, and apply it to package 112, and then is ready to process the next package. After all packages in a group of packages to be shipped together are processed printer 100 may be used as a conventional computer output line printer to generate a manifest for the entire group, or such manifest may be generated on a second printer (not shown) concurrently.

It should be recognized that the above described embodiments have been provided by way of illustration only and that other embodiments of the subject invention will be apparent to those skilled in the art from consideration of the above description and the attached drawings. Accordingly, limitations on the subject invention are to be found only in the claims set forth below.

What is claimed is:

1. A label printer comprising:

(a) a computer output line printer said line printer further comprising:

(a1) a substantially cylindrical platten roller (a2) a bail rod assembly means having a bail rod mounted parallel to the axis of, and resiliently bearing against, said platten roller for holding a web against said platten during printing;

(a3) a tractor feeder means, positioned on the path of said web through said printer downstream of said platten roller and said bail rod assembly, for drawing said web through said printer;

(a4) said platten roller, bail rod assembly means and tractor feeder means together defining a first web path for travel of a web of material through said label printer, said first path comprising a substantial straight portion between the point where said web passes between said bail rod assembly and said platten roller and said tractor feeder means; and, (b) separator means for defining a separating edge spaced from and parallel to said bail rod, said separating edge, said platten roller, said bail rod and said tractor feeder means defining a second path for travel of a web of material through said label printer, said second path comprising a portion between the point where said web passes between said bail rod assembly and said platten roller and said tractor feeder means where said separating edge changes the direction of travel of said web by an angle, alpha, said angle, alpha, being sufficient, when said web is a web of release liner having labels mounted thereon, to separate said labels from said release liner as said release liner passes over said separating edge.

2. The label printer of claim 1 wherein said separator means further comprises a separator rod for defining said separating edge, said separator rod being free to rotate with advance of said web.

3. The label printer of claim 1 wherein said tractor feeder means has the capability to draw webs having various widths through said printer, said widths ranging from substantially equal to the length of said platten roller to substantially less than the width of said platten roller.

4. The label printer of claim 1 wherein said separating edge is rotatable around said bail rod to allow adjustment of said angle, alpha.

5. The label printer of claim 1 wherein said bail rod assembly may be displaced away from said platten roller and further comprising means for holding said bail road assembly against said platten roller while said printer is in operation.

6. In a manifest system of the type having weighing means for determining the weight of a parcel to be shipped, input means for input of additional information pertaining to said parcel, data processing means for determining variable information pertaining to said parcels and for compiling manifests relating to groups of parcels, and printing means for printing labels including said variable information and said manifests, improved printing means comprising:

(a) a computer output line printer said line printer further comprising:

(a1) a substantially cylindrical platten roller (a2) a bail rod assembly means having a bail rod mounted parallel to the axis of, and resiliently bearing against, said platten roller for holding a web against said platten during printing;

(a3) a tractor feeder means, positioned on the path of said web through said printer downstream of said platten roller and said bail rod assembly, for drawing said web through said printer;

(a4) said platten roller, bail rod assembly means and tractor feeder means together defining a first web path for travel of a web of material through said label printer, said first path comprising a substantially straight portion between said between the point where said web passes between said bail rod assembly and platten roller and said tractor feeder means; and (b) separator means for defining a separating edge spaced from and parallel to said bail rod, said separating edge, said platten roller, said bail rod and said tractor feeder means defining a second path for travel of a web of material through said label printer, said second path comprising a portion between between the point where said web passes between said bail rod assembly and said platten roller and said tractor feeder means where said separating edge changes the direction of travel of said web by an angle, alpha, said angle, being sufficient, when said web is a web of release liner having labels mounted thereon, to separate said labels from said release liner as said release liner passes over said separating edge.

7. The manifest system of claim 6 wherein said separator means further comprises a separator rod for defining said separating edge, said separator rod being free to rotate with advance of said web.

8. The manifest system of claim 6 wherein said tractor feed means has the capability to draw webs having various widths through said printer said widths ranging from substantially equal to the length of said platten roller to substantially less than the width of said platten roller.

9. The manifest system of claim 6 wherein said separating edge is rotatable around said bail rod to allow adjustment of said angle, alpha.

10. The manifest system of claim 6 wherein said bail rod assembly may be displaced away from said platten roller and further comprising means for holding said bail rod assembly against said platten roller while said printer is in operation.

* * * * *